US006436007B1

(12) United States Patent
Eschenbach

(10) Patent No.: US 6,436,007 B1
(45) Date of Patent: Aug. 20, 2002

(54) ELLIPTICAL EXERCISE MACHINE WITH ADJUSTMENT

(76) Inventor: Paul William Eschenbach, 143 Lakeland Ave., Moore, SC (US) 29369

( * ) Notice: Subject to any disclaimer, the term of this patent is extended or adjusted under 35 U.S.C. 154(b) by 0 days.

(21) Appl. No.: 09/478,782

(22) Filed: Jan. 7, 2000

Related U.S. Application Data

(63) Continuation-in-part of application No. 09/067,261, filed on Apr. 27, 1998, now Pat. No. 6,142,915, which is a continuation-in-part of application No. 08/711,087, filed on Sep. 9, 1996, now Pat. No. 5,788,610.

(51) Int. Cl.[7] ..... A63B 69/16; A63B 22/04
(52) U.S. Cl. ..... 482/52; 482/51; 482/57
(58) Field of Search ..... 482/51, 57, 52, 482/70, 53, 71, 79, 80

(56) References Cited

U.S. PATENT DOCUMENTS

| | | | | | |
|---|---|---|---|---|---|
| 219,439 | A | * | 9/1879 | Blend | 482/51 |
| 5,290,211 | A | * | 3/1994 | Stearns | 482/52 |
| 5,433,880 | A | * | 7/1995 | Knudsen | 482/57 |
| 5,518,473 | A | * | 5/1996 | Miller | 482/51 |
| 5,529,555 | A | * | 6/1996 | Rodgers | 482/57 |
| 5,562,574 | A | * | 10/1996 | Miller | 482/51 |
| 5,573,480 | A | * | 11/1996 | Rodgers | 482/57 |
| 5,577,985 | A | * | 11/1996 | Miller | 482/52 |
| 5,788,610 | A | * | 8/1998 | Eschenbach | 482/52 |

* cited by examiner

*Primary Examiner*—Stephen R. Crow

(57) ABSTRACT

The present invention relates to a standup exercise apparatus that simulates walking, jogging and climbing with arm exercise. More particularly, the present invention relates to an exercise machine having separately supported pedals for the feet and arm exercise coordinated with the motion of the feet.

Cross trainers guide the feet along a generally elliptical shaped curve to simulate the motions of jogging and climbing. Existing machines often produce user problems such as excessive foot articulation. The present invention is an improved elliptical exercise machine capable of extended exercise with fewer user problems. Further, the cross trainer is adjustable to vary the motion of the elliptical stride from walking to climbing.

A foot support member is guided by a guide linkage on one end and driven by a crank linkage on the other end. The resulting pedal motion has less severe pedal angles than a simple crank cross trainer. Handles are coupled to the guide linkage for coordinated arm exercise.

18 Claims, 6 Drawing Sheets

ELLIPTICAL EXERCISE MACHINE WITH ADJUSTMENT

This application is a Continuation-in-Part of application Ser. No. 09/067,261 filed Apr. 27, 1998 now U.S. Pat. No. 6,142,915 which is a Continuation-in-Part of application Ser. No. 08/711,087 filed Sep. 9, 1996 issued U.S. Pat. No. 5,788,610.

BACKGROUND OF THE INVENTION

1. Field

The present invention relates to a standup exercise apparatus that simulates walking, jogging and climbing with arm exercise. More particularly, the present invention relates to an exercise machine having separately supported pedals for the feet and arm exercise coordinated with the motion of the feet. The pedal lift is controlled separately and can be varied.

2. State of the Art

The benefits regular exercise to improve overall health, appearance and longevity are well documented in the literature. For exercise enthusiasts the search continues for safe apparatus that provides full body exercise for maximum benefit in minimum time.

Recently, a new category of exercise equipment has appeared on the commercial market called elliptical cross trainers. These cross trainers guide the feet along a generally elliptical shaped curve to simulate the motions of jogging and climbing. Generally they are large exercise machines using long cranks to generate a long foot stride. There is a need for a more compact elliptical exercise machine capable of a similar long stride using a linkage to modify the crank. Further, there is a need to adjust lift of the elliptical motion to vary the amount of climb desired by the operator during operation.

Numerous combinations of levers and cranks to combine exercise for arms and feet can be found. Hex in U.S. Pat. No. 4,645,200 combines arm and foot levers for sit down exercise while Bull et al. in U.S. Pat. No. 4,940,233 combines arm and foot levers for standup exercise. Lucas et al. in U.S. Pat. No. 4,880,225 offer oscillating arm levers coupled to the foot crank by a connecting rod. Dalebout et al. in U.S. Pat. Nos. 4,971,316 and 5,000,444 also shows oscillating swing arms coupled to the foot crank by an offset second crank and connecting rod. Lom in U.S. Pat. No. 4,986,533 offers oscillating arms driven by a crank-slider coupled to a foot crank.

Recently, there has been an effort to improve the up and down motion of stair climbers by the addition of horizontal movements. Habing in U.S. Pat. Nos. 5,299,993 and 5,499,956 offers an articulated linkage controlled through cables by motor to move pedals through an ovate path. Both pedal pivots follow basically the same guidance path curve directed by a motor controller. Stearns in U.S. Pat. Nos. 5,290,211 and 5,299,993 shows a stair stepping exercise machine which incorporates horizontal movement using a combination of vertical parallelogram linkage and horizontal parallelogram linkage to guide the foot pedals. The parallelogram linkages serve to maintain the pedal at a constant angle relative to the floor during a pedal cycle. The pedal pivots move through similar undefined guide paths.

Standup cycling is described in various patents such as U.S. Pat. No. 3,563,541 (Sanquist) which uses weighted free pedals as load resistance and side to side twisting motion. Also U.S. Pat. Nos. 4,519,603 and 4,477,072 by DeCloux describe standup cycling with free pedals in a lift mode to simulate body lifting. Eschenbach in U.S. Pat. No. 5,279,529 shows several embodiments of elliptical pedal motion configured to maintain the heel of the user on the pedal during a substantial portion of the pedal cycle.

Standup pedal exercise is shown in U.S. Pat. No. 4,643,419 (Hyde) and by Jarriel et al. In U.S. Pat. No. D330,236 where pedal platforms move by dual crank motion but remain parallel to the floor. Knudsen in U.S. Pat. No. 5,433,680 shows an elliptical path generating mechanism with pedals having only one pivot allowing the pedal to rotate unconstrained about the pivot as in a bicycle crank.

Standup pedal exercise combined with arm levers attached to the pedals is shown in Kummerlin et al. German Pat. No. 2,919,494 and in Geschwender U.S. Pat. No. 4,786,050. Standup pedal exercise coupled with oscillating swing arms is shown in Miller U.S. Pat. Nos. 5,242,343 and 5,383,829 and in Eschenbach U.S. Pat. No. 5,423,729. All of these exercise machines use pedals having two pedal pivots which are guided by a first circular guide path curve generated by a crank which rotates through one full revolution during a pedal cycle and a second arc guide path curve generated by a rocker link or track.

Recently, numerous elliptical exercise machines have appeared in the patent literature. Rogers, Jr. in U.S. Pat. Nos. 5,527,246, 5,529,555, 5,540,637, 5,549,526, 5,573,480, 5,591,107, 5,593,371, 5,593,372, 5,595,553, 5,611,757, 5,637,058, 5,653,662 and 5,743,834 shows elliptical pedal motion by virtue of various reciprocating members and geared linkage systems. Miller in U.S. Pat. Nos. 5,518,473, 5,562,574, 5,611,756, 5,518,473, 5,562,574, 5,577,985, 5,755,642 and 5,788,609 also shows elliptical pedal motion using reciprocating members and various linkage mechanisms along with oscillating guide links with control links to determine pedal angles. Ryan et al. in U.S. Pat. No. 5,899,833 shows an elliptical cross trainer having a forward crank driving a pedal linkage underneath the operator.

Chang in U.S. Pat. No. 5,803,872 and Yu et al. in, U.S. Pat. No. 5,800,315 show a pedal supported by a rocker link and driven with a pair of links located under the pedal pivotally connected to a crank. Maresh et al. in U.S. Pat. No. 5,792,026 show a foot support member supported by a rocker link and driven by a double crank mechanism. Lee in U.S. Pat. No. 5,779,598 and Chen in U.S. Pat. No. 5,823,914 show a pedal link driven by two separate cranks. Lin et al. in U.S. Pat. No. 5,769,760 offers elliptical foot and hand motion. Sands et al. U.S. Pat. No. 5,755,643 shows elliptical foot motion with folding front post.

Lee in U.S. Pat. No. 5,746,683 shows a foot support member supported on one end with a compound rocker wherein a slider and handle lever support the rocker. Kuo in U.S. Pat. No. 5,836,854 offers a linear foot support member connected on one end to a crank and guided along an arcuate curve under the pedal by a linkage on the other end. Wang et al. U.S. Pat. No. 5,830,112 shows a foot support member sliding on a pivot on one end and attached to a crank on the other that can fold. Chen U.S. Pat. No. 5,823,917 shows a foot support member driven by a crank on one end and supported by a stationary roller on the other. Chen U.S. Pat. No. 5,820,524 offers a slider crank mechanism having a pedal pivotally attached with a control link to articulate the pedal angle.

Chen U.S. Pat. Nos. 5,779,599 and 5,762,588 shows an elliptical pedal movement with a roller interface between the foot support member and crank. Chen in U.S. Pat. No. 5,759,136 shows a foot support member with a moving pedal for adjustable elliptical motion wherein a link from the pedal to the crank can be repositioned to change the pedal stroke length. Kuo U.S. Pat. No. 5,846,166 shows a foot support member guided on one end by a roller and driven on the other end by a four bar linkage. Stearns et al. in U.S. Pat. No. 5,848,954 offers a foot support member pivoted on one end with a lift crank on the other and a pedal moving on the foot support member to generate elliptical type foot motion.

Maresh et al. in U.S. Pat. No. 5,893,820 shows an adjustable lift elliptical cross trainer wherein the operator must interrupt exercise to relocate various pins to alter the pedal motion. Kuo U.S. Pat. No. 5,836,854 shows a foot support member driven by a crank and guided on one end by a linkage hanging from a "Z" shaped bar that may be adjusted. Whan-Tong et al. in U.S. Pat. No. 5,685,804, shows a foot support member driven by a simple crank having an adjustable ramp to vary pedal lift. Eschenbach in U.S. Pat. No. 5,692,994 shows an elliptical cross trainer which has an adjustable upright support member which allows variable pedal motion.

There is a need for a pedal operated exercise machine that can be safely operated in the standup position whereby the arms and legs can be exercised with the feet moving through a generally elliptical path wherein pedal lift is variable during operation.

It is one objective of this invention to provide an elliptical pedal movement with a compound crank that reduces the steep pedal angle which can occur with a simple crank. Another object of this invention is to provide arm exercise that is coordinated with the pedal movement which allows pedal lift to be adjusted during operation.

SUMMARY OF THE INVENTION

The present invention relates to the kinematic motion control of pedals which simulate running, climbing and cycling during several modes of operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through an oblong or elongate curve motion while pedal angles are controlled to be generally horizontal during the pedal cycle where the leg is generally extended. As the foot is raised, the heel of the foot remains generally in contact with the inclining pedal for safer operation. Arm exercise is by arm levers coordinated with the mechanism guiding the foot pedals. An adjustment mechanism is provided to move one of the pivots of the path generating mechanism during operation to change the pedal motion and the arm exercise motion.

In the preferred embodiment, the apparatus includes a separate pedal for each foot, each pedal being extended by a foot support member and partially supported by an oblong guide path curve for the first foot support member portion at a pivot. The oblong guide path generating mechanism has a rotary crank which completes one full revolution during a pedal cycle and is phased generally opposite the crank for the other pedal through a crankshaft bearing housing attached to the framework. Connected to the crank is a coupler link which is also connected to a rocker link which is pivotally attached to a movable upright support.

The movable upright support is located at a predetermined distance from the crankshaft bearing housing. The coupler link is extended to a coupler point pivot, forming a triangular pivot pattern in conjunction with the other two pivots, which will generate the desired oblong or elongate guide path curve as a coupler curve of a four-bar linkage referred to in the literature as a crank-rocker mechanism. The oblong guide path curve for this embodiment is a prolate guide path curve having both long sides similarly aligned incurvate. A change in the proportions of the four-bar linkage will effect a change in the shape and orientation of the coupler curve. The first foot support pivot is attached to the coupler link at the coupler point pivot.

The foot support member is supported at a second foot support member portion with a pivot by foot support guides shown as rocker links which are rotatably connected to an upright support member of the framework. An actuator is pivotally attached to the movable upright support and the other upright support member to adjust the predetermined distance between the crankshaft bearing housing and the movable upright support. Extension or retraction of the actuator causes the movable upright support to pivot at the base and relocates the rocker arm pivot of the path generating mechanism whereby the oblong guide path curve is changed in shape and in orientation. The changed oblong guide path curve gives different motion to the pedals and arm levers to exercise different muscles.

The movable upright support is pivoted at the base and can swing front to back according to the position of the actuator pivotally attached to the movable upright support and a frame member. When the actuator is extended or retracted, the rocker link pivot moves to relocate the arc guide path curve. Both the pedal motion and the hand path change during operation to exercise different muscles. Alternately, the rocker link guide pivot can be moved to change the path of the second portion of the foot support member for different pedal motions with only a modest change to the arm lever motions.

In an alternate embodiment, the foot support member is guided by a linkage for each foot support member pivotally attached to the crank that comprises a rocker link, a coupler link connecting the rocker link to the crank and a connector link pivotally connected to the coupler link and a first portion of the foot support member. A control link pivotally connects the connector link to the rocker link. A second portion of the foot support member has a back and forth movement caused by a guide. The first portion of the foot support member moves along a bent oblong curve similar to the preferred embodiment. Either the rocker link pivot to the framework or the guide can be moved to change the pedal motion.

In another alternate embodiment, the connector link of the previous alternate embodiment has a roller at one end to support the first portion of the foot support member. The second portion of the foot support member is guided by a second rocker link which is pivoted to the framework. A transfer link pivotally connects the first and second rocker links. The first portion of the foot support member moves along a bent oblong curve similar to the preferred embodiment. Either the first or the second rocker link pivot to the framework can be moved to change the pedal motion.

In another alternate embodiment, the connector link of the previous embodiment is pivotally connected to the coupler link and to the first portion of the foot support member. The transfer link pivotally couples the first and second rocker links. The first portion of the foot support member moves along a bent oblong curve similar to the preferred embodiment. Either the first or the second rocker link pivot to the framework can be moved to change the pedal motion.

Load resistance is applied to the crank in each embodiment by a sprocket which drives a chain to a smaller sprocket attached to a rotating flywheel supported by the framework. In each embodiment, the flywheel must overcome the frictional force provided by disc brake pads on either side of the flywheel. Adjustment of the pad force upon the flywheel provides variable intensity exercise for the operator. Other forms of load resistance such as alternator, magnetic, air, belt, etc. may also be used.

In summary, this invention provides the operator with stable foot pedal support having motions that simulate running, climbing and cycling with very low joint impact while offering different pedal motion and upper body exercise.

DETAILED DESCRIPTION OF THE EMBODIMENTS

Figure 1:
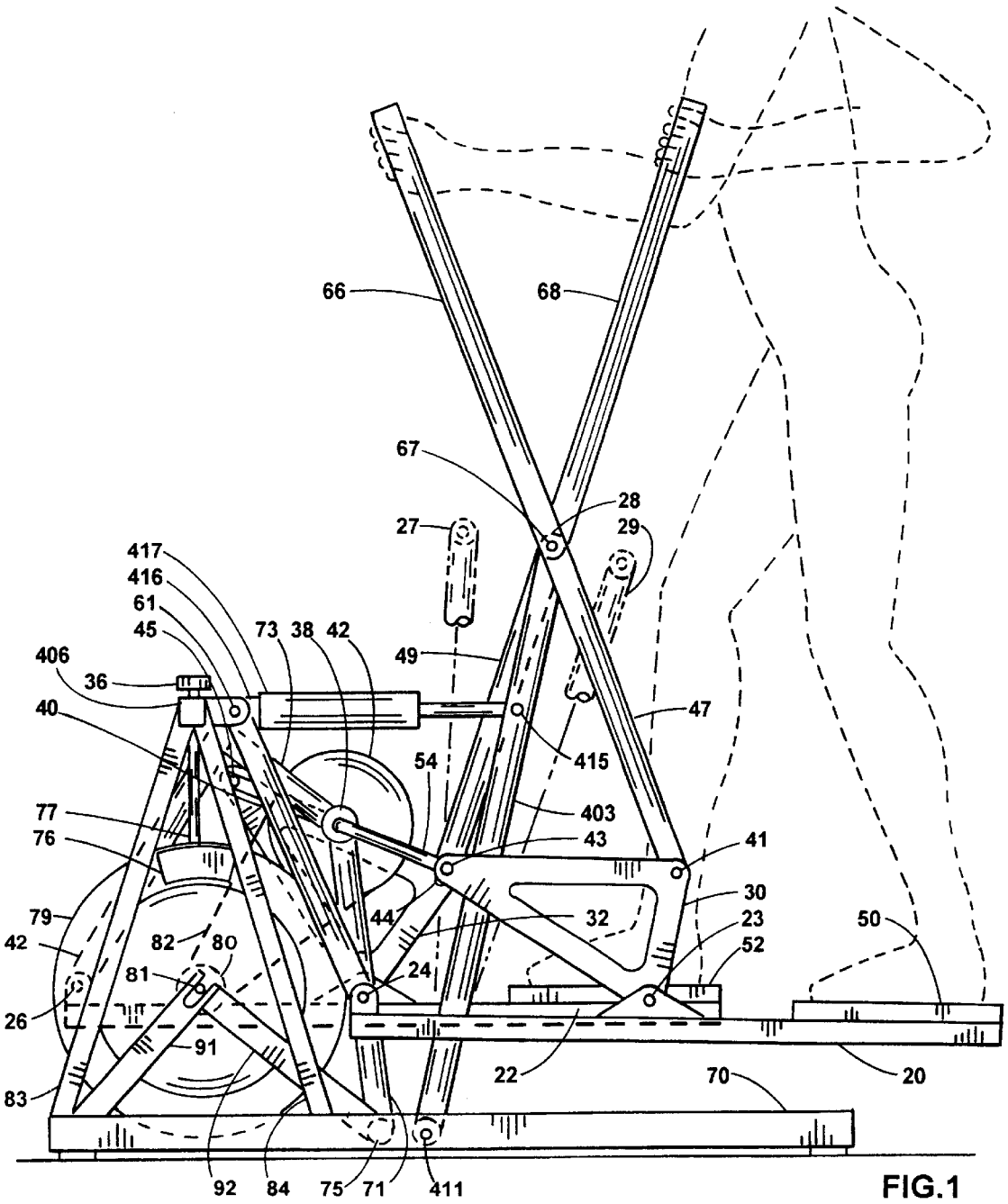
FIG. 1 is a right side elevation view of the preferred embodiment of an exercise machine constructed in accordance with the present invention.
Figure 2:
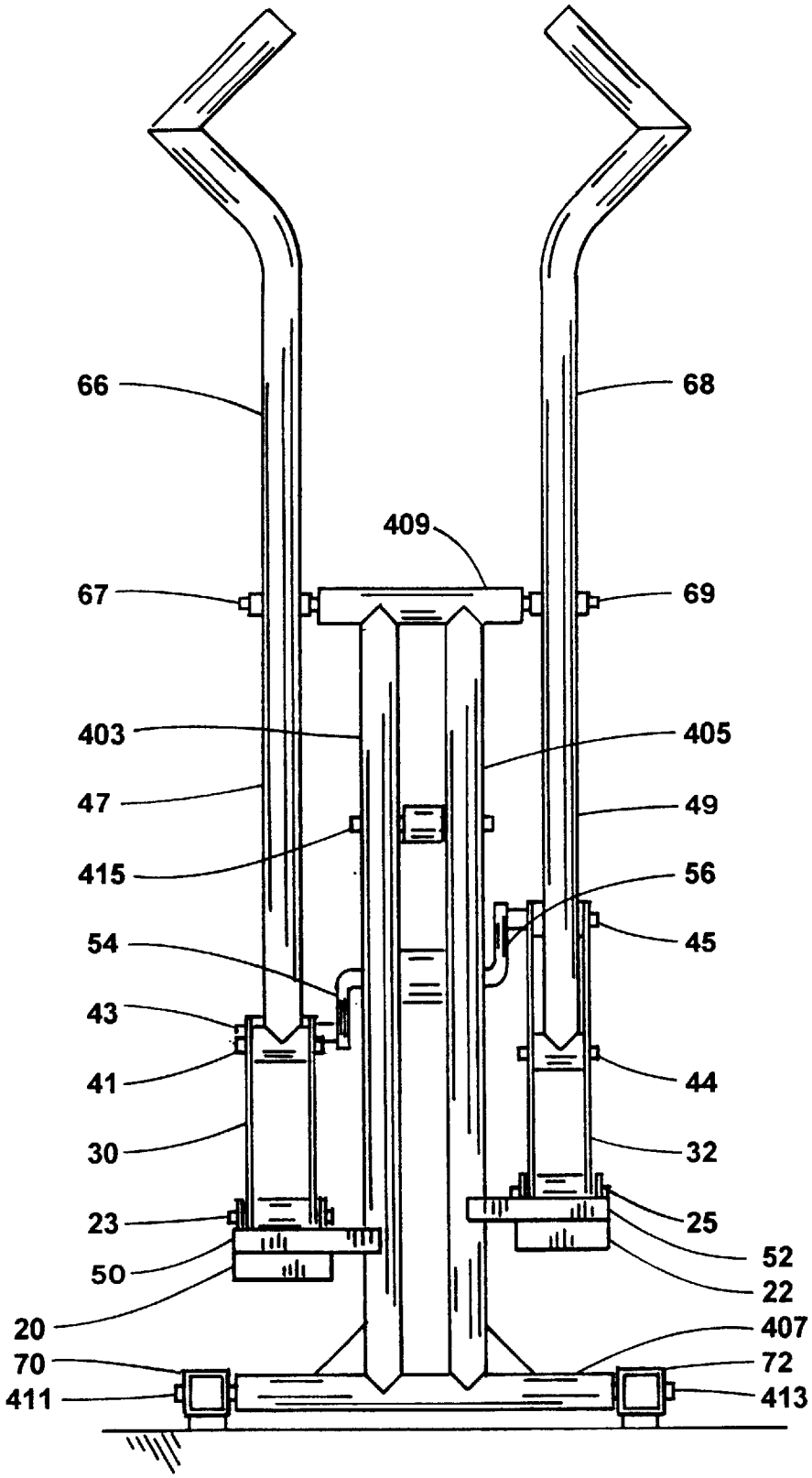
FIG. 2 is the front view of the preferred embodiment shown in FIG. 1.
Figure 3:
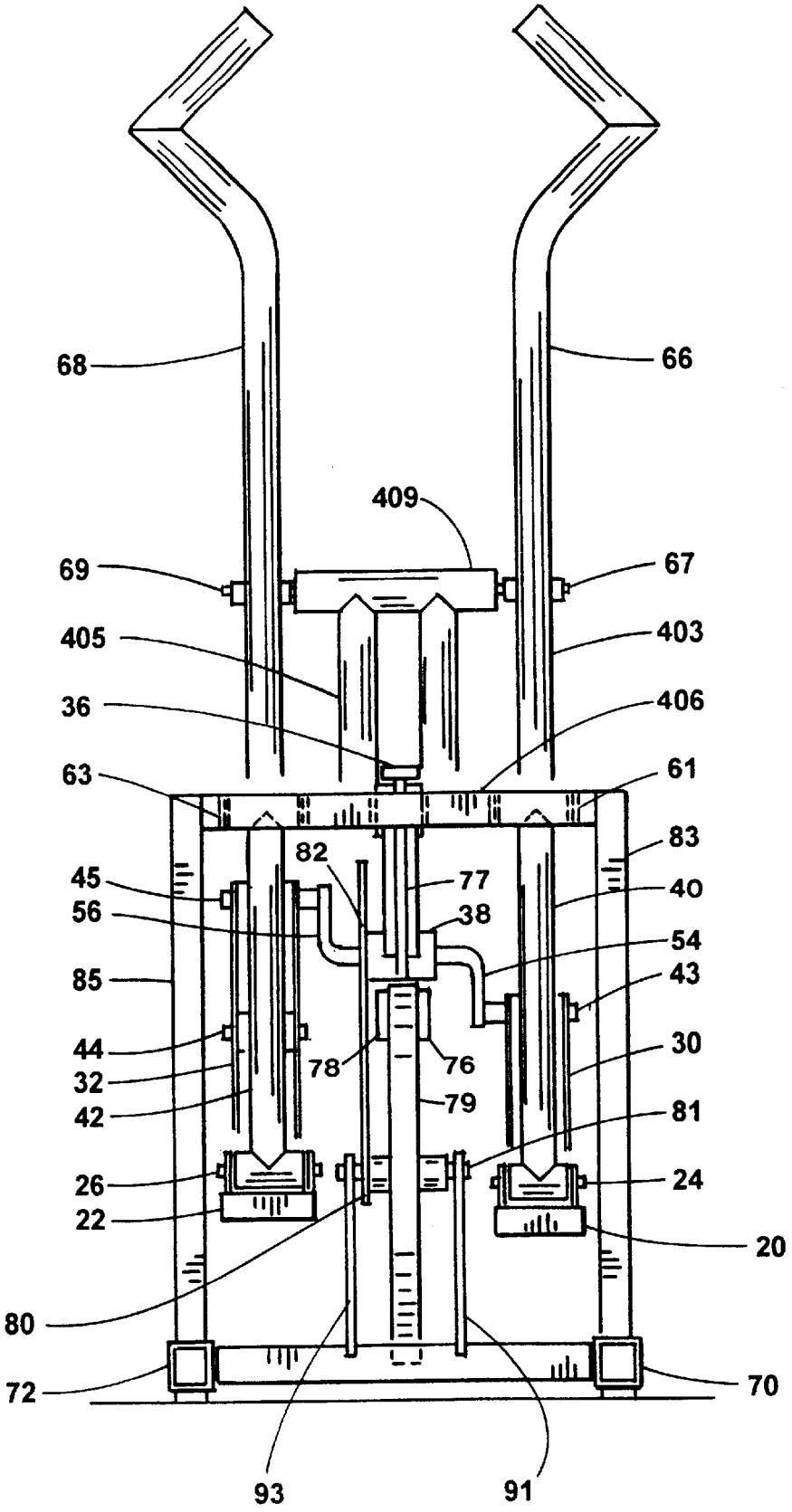
FIG. 3 is the rear view of the preferred embodiment shown in FIG. 1.

Referring to the drawings in detail, pedals 50 and 52 are shown in FIGS. 1, 2 and 3 in the most forward and rearward positions of the first embodiment. Pedals 50 and 52 are supported by foot support members 20 and 22 which have first foot support pivots 23,24 in a first portion and second foot support pivots 25,26 in a second portion, respectively. Foot support pivots 23 and 25 are pivotally attached to coupler links 30 and 32 which guide pedal pivots 23 and 25 along an oblong guide path curve similar to guide path curve 2 shown in FIG. 4. Coupler link 30 is pivotally attached to rocker link 47 at pivot 41 and to crank 54 at pivot 43 while coupler link 32 is pivotally attached to rocker link 49 at pivot 44 and to crank 56 at pivot 45. Cranks 54 and 56 are connected in opposing directions by crankshaft journal 55 (not shown) which is rotatably secured to the framework by bearing housing 38. Rocker links 47 and 49 are pivotally attached to upright support cross member 409 at pivots 67 and 69, respectively. Rocker links 47 and 49 extend upward to become arm levers 66 and 68 for arm exercise.

Foot support pivots 24 and 26 are pivotally connected to rocker links 40 and 42 which are pivotally attached to frame crossover member 406 at pivots 61 and 63.

Frame members 70 and 72 are configured to be supported by the floor and are connected by crossover members 75 and 87. The upright support members 403 and 405 are connected to crossover members 407 which is pivotally attached to frame members 70 at pivot 411 and to frame member 72 at pivot 413 on one end and attached to crossover member 409 on the other.

Actuator 417 is pivotally connected to upright support members. 403 and 405 at pivot 415 on one end and to frame crossover member 406 at pivot 416. The middle position of the actuator 417 is shown in FIG. 1 as position 28 of the crossover member 409.

Frame crossover member 406 is attached to frame member 70 by inclined support members 83 and 84 and connected to frame member 72 by inclined support members 85 and 86. Crank bearing housing 38 is connected to inclined support member 71 which is attached to crossover member 75 and attached to inclined support member 73 which is attached to crossover member 406.

Flywheel 79 is rotatably supported at pivot 81 which is journaled to flywheel support members 91,92 which are connected to horizontal frame member 70, and flywheel support members 93,44 which are connected to horizontal frame member 72. Load resistance is imposed upon crank 54 by sprocket 42 which is connected to a smaller sprocket 80 by chain 82 to drive the flywheel 79. Brake pads 76 and 78 apply frictional resistance to flywheel 79 rotation by mechanism 77 attached to crossover support 406. Load resistance is varied by turning knob 36.

Application of body weight on the pedals 50,52 and force applied at the arm levers 66,68 cause the four-bar linkage to rotate the flywheel 79 for a gain in momentum. This flywheel 79 momentum will carry the linkage system through any dead center positions of the crank 54,56. The pedals 50,52 and arm levers 66,68 can be operated to drive the flywheel 79 in either direction of rotation.

Figure 4:
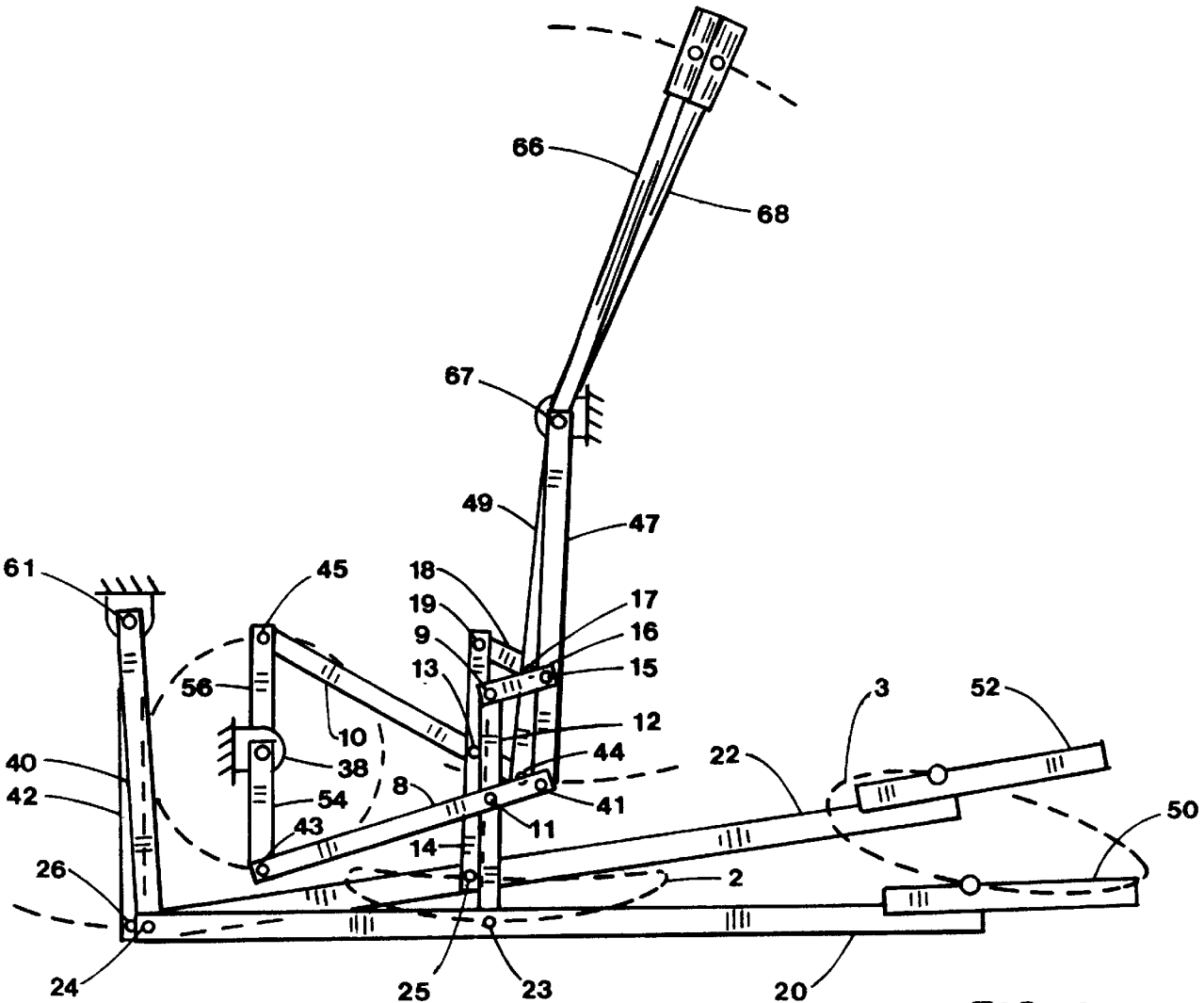
FIG. 4 is is a side elevation view of an alternate embodiment of the present invention.

In an alternate embodiment, pedals 50,52 are shown in the uppermost and lowermost positions in FIG. 4. Crank 54,56 is rotatably connected to the framework (not shown) at bearing housing 38. Rocker links 47,49 are connected to the framework (not shown) at pivots 67,69. Coupler links 8,10 are connected to the crank 54,56 at pivots 43,45 and to rocker links 47,49 at pivots 41,44. Connector links 12,14 are connected to the coupler links 8,10 at pivots 11,13 and to the first portion of foot support members 20,22 at pivots 23,25. Control links 16,18 are connected to connector links 12,14 at pivots 9,19 and to rockers 47,49 at pivots 15,17. Rocker links 40,42 are connected to the second portion of foot support members 20,22 at pivots 24,26 and to the framework (not shown) at pivots 61,63. Pivots 23,25 follow the bent oblong curve 2 while pedals 50,52 follow the oblong curve 3. Either rocker pivots 67,69 or rocker pivots 61,63 can be moved to change the pedal 50,52 motion during operation of the exercise machine using an actuator 417 similar to the preferred embodiment.

Figure 5:
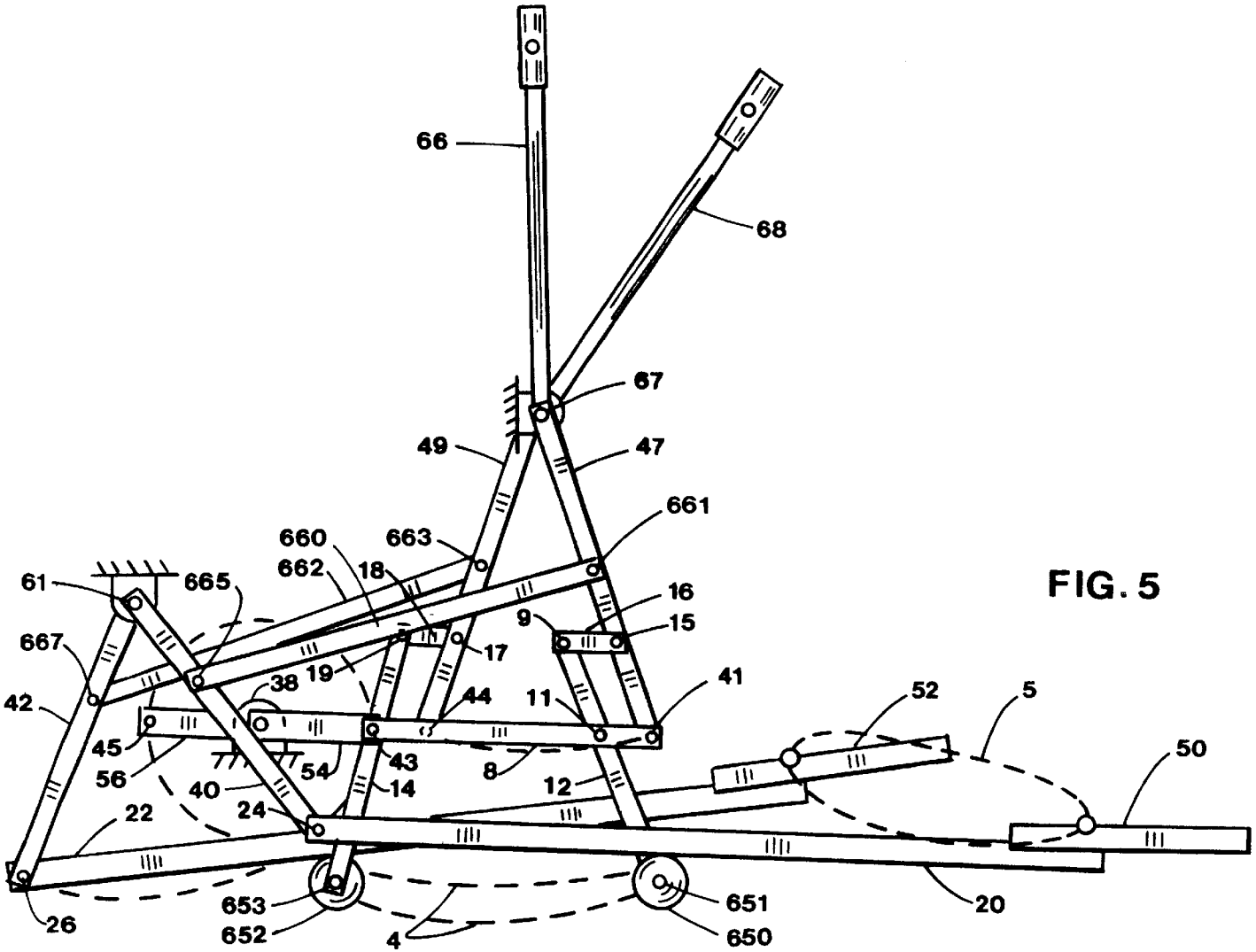
FIG. 5 is a side elevation of an alternate embodiment of the present invention.

In an another alternate embodiment, pedals 50,52 are shown in the most forward and rearward positions in FIG. 5. Crank 54,56 is rotatable connected to the framework (not shown) at bearing housing 38. Rocker links 47,49 are connected to the framework (not shown) at pivots 67,69. Coupler links 8,10 are connected to the crank 54,56 at pivots 43,45 and to rocker links 47,49 at pivots 41,44. Connector links 12,14 are connected to the coupler links 8,10 at pivots 11,13. Rollers 650,652 are rotatably attached to connector links 12,14 at pivots 651,653 and support the underside of the foot support members 20,22 at a first portion. Control links 16,18 are connected to connector links 12,14 at pivots 9,19 and to rockers 47,49 at pivots 15,17. Rocker links 40,42 are connected to foot support members 20,22 at a second portion with pivots 24,26 and to the framework (not shown) at pivots 61,63. Transfer links 660,662 connect to rocker links 47,49 at pivots 661,663 and to rocker links 40,42 at pivots 665,667. Roller pivots 651,653 follow the bent oblong curve 4 while pedals 50,52 follow the oblong curve 5. Either rocker pivots 67,69.or rocker pivots 61,63 can be moved to change the pedal 50,52 motion during operation of the exercise machine.

Figure 6:
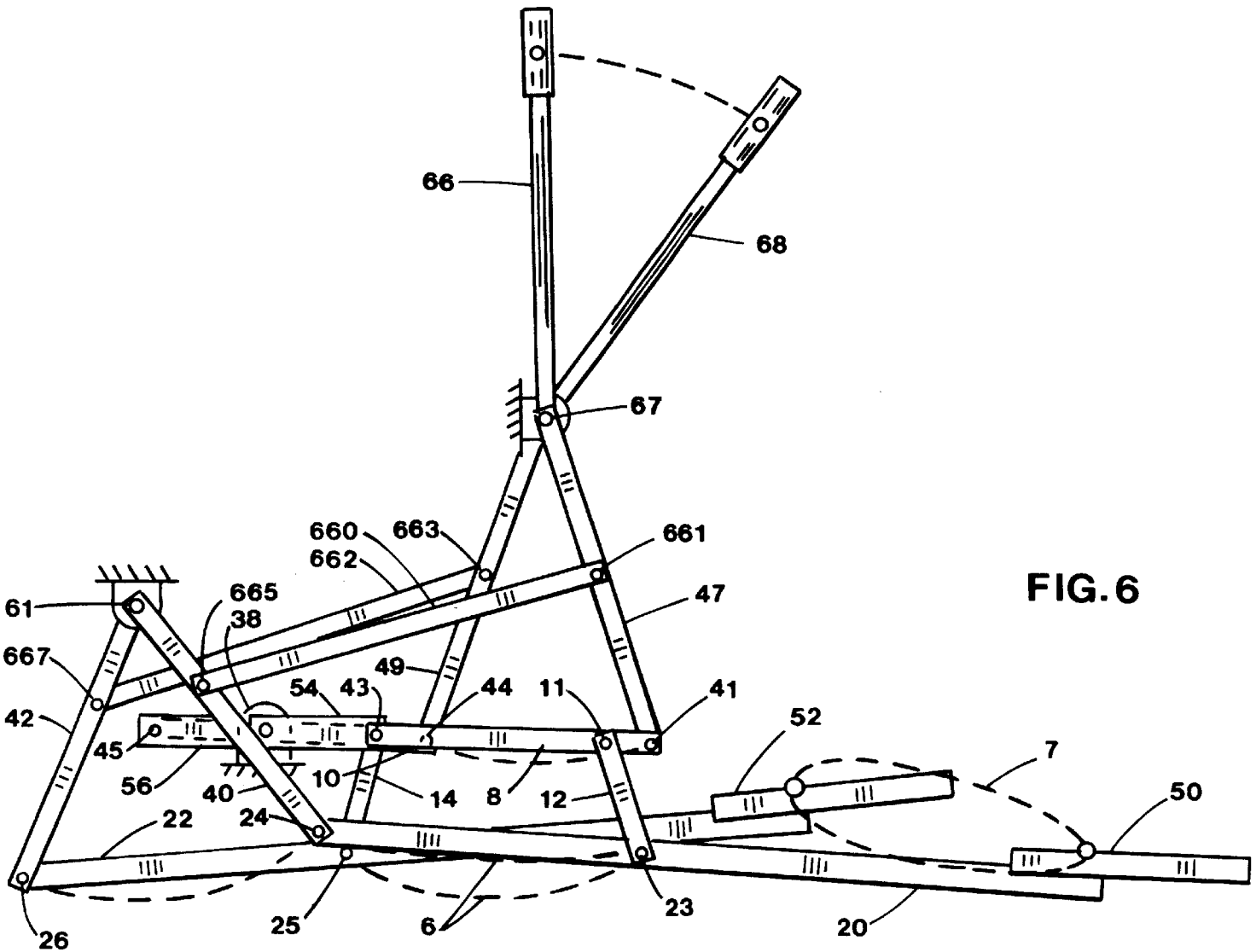
FIG. 6 is a side elevation of an alternate embodiment of the present invention.

In an another alternate embodiment, pedals 50,52 are shown in the most forward and rearward positions in FIG. 6. Crank 54,56 is rotatably connected to the framework (not shown) at bearing housing 38. Rocker links 47,49 are connected to the framework (not shown) at pivots 67,69. Coupler links 8,10 are connected to the crank 54,56 at pivots 43,45 and to rocker links 47,49 at pivots 41,44. Connector links 12,14 are connected to the coupler links 8,10 at pivots

11,13 and to the first portion of foot members 20,22 at pivots 23,25. Rocker links 40,42 are connected to foot support members 20,22 at a second portion with pivots 24,26 and to the framework (not shown) at pivots 61,63. Transfer links 660,662 connect to rocker links 47,49 at pivots 661,663 and to rocker links 40,42 at pivots 665,667. Pivots 23,25 follow the bent oblong curve 6 while pedals 50,52 follow the oblong curve 7. Either rocker pivots 67,69 or rocker pivots 61,63 can be moved to change the pedal 50,52 motion during operation of the exercise machine.

For all of the alternate embodiments arm exercise 66,68, the frameword, actuator 417 and load resistance 76,79 is similar to the preferred embodiment.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise machine comprising:

a framework, said framework configured to be supported by the floor;

a pair of foot support members, each having a first and a second portion and a foot engaging pedal means;

a crank means, said crank means rotatably attached to said framework means projecting outwardly therefrom on both sides thereof;

a pair of linkage means, each said linkage means including a rocker link means operably associated with said framework and a coupler link means interposed between said crank means and said rocker link means, said linkage means forming a mechanism to guide said first portion of said foot support members;

said linkage means further comprises a connector link, said connector link pivotally connected to said coupler link and operably associated with said first portion of said foot support member;

a pair of guide means, each said guide means operably associated with said foot support member and said framework to cause said second portion of said foot support member to have a back and forth movement;

said pedal means configured to move relative to said framework when the foot of the user is rotating said crank means whereby said pedal means follows an oblong curve path.

2. The exercise machine according to claim 1 wherein said oblong curve path is generally elliptical in shape.

3. The exercise machine according to claim 1 further comprising an adjustment means, said adjustment means operably associated with said linkage means whereby the motion of said pedal means can be changed during operation of said exercise machine.

4. The exercise machine according to claim 1 further comprising an adjustment means, said adjustment means operably associated with said guide means whereby the motion of said pedal means can be changed during operation of said exercise machine.

5. The exercise machine according to claim 1 further comprising an arm exercise means operably associated with said linkage means.

6. The exercise machine according to claim.1 further comprising a load resistance means operably associated with said crank means.

7. The exercise machine according to claim 1 wherein said guide means is a lever pivotally connected to said second portion of said foot support member and pivotally connected to said framework.

8. The exercise machine according to claim 1 wherein said foot support member is configured with said pedal means on one end and said second portion at the other end with said first portion positioned intermediate the ends.

9. The exercise machine according to claim 1 further comprising a roller means, said roller means rotatably attached to said connector link and rollably associated with said foot support member.

10. The exercise machine according to claim 1 further comprising a transfer link, said transfer link operably. associated with said linkage means and said guide means.

11. The exercise machine according to claim 1 wherein said pedal means follows a generally elliptical curve while said first portion of said foot support member follows a bent oblong guide path curve and said second portion of said foot support member follows an arcuate guide path curve.

12. The exercise machine according to claim 1 further comprising arm exercise, said arm exercise operably associated with said guide means.

13. An exercise machine comprising:

a framework, said framework configured to be supported by the floor;

a pair of foot support members, each having a first and a second portion and a foot engaging pedal means;

a crank means, said crank means rotatably attached to said framework means projecting outwardly therefrom on both sides thereof;

a pair of rocker links, each said rocker link operably associated with said framework;

a pair of coupler links, each said coupler link pivotally connected to said rocker link and said crank means;

a pair of connector links, each connector link pivotally connected to said coupler link and operably associated with said first portion of said foot support member;

a pair of guide means, each said guide means operably associated with said foot support member and said framework to cause said second portion of said foot member to have a back and forth movement;

said pedal means configured to move relative to said framework when the foot of the user is rotating said crank means whereby said pedal means follows an oblong curve path.

14. The exercise machine according to claim 13 further comprising an adjustment means, said adjustment means operably associated with said rocker links whereby the motion of said pedal means can be changed during operation of said exercise machine.

15. The exercise machine according to claim 14 further comprising an adjustment means, said adjustment means operably associated with said guide means whereby the motion of said pedal means can be changed during operation of said exercise machine.

16. The exercise machine according to claim 13 further comprising an arm exercise means operably associated with said rocker links.

17. The exercise machine according to claim 13 further comprising a roller means, said roller means rotatably attached to said connector link and rollably associated with said foot support member.

18. The exercise machine according to claim 13 further comprising a pair of transfer links, each said transfer link operably associated with said rocker link and said guide means.

* * * * *